US010573237B2

(12) United States Patent
Chen

(10) Patent No.: US 10,573,237 B2
(45) Date of Patent: Feb. 25, 2020

(54) PIXEL AND DISPLAY DEVICE HAVING THE PIXEL

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventor: Xiaolong Chen, Guangdong (CN)

(73) Assignee: SHENZHEN CHINA STAR OPROELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 31 days.

(21) Appl. No.: 15/945,238

(22) Filed: Apr. 4, 2018

(65) Prior Publication Data

US 2019/0206323 A1 Jul. 4, 2019

Related U.S. Application Data

(63) Continuation of application No. PCT/CN2018/074008, filed on Jan. 24, 2018.

(30) Foreign Application Priority Data

Dec. 29, 2017 (CN) ..... 2017 1 1479647

(51) Int. Cl.
*G09G 3/3241* (2016.01)
*G09G 3/20* (2006.01)

(52) U.S. Cl.
CPC ..... *G09G 3/3241* (2013.01); *G09G 3/20* (2013.01); *G09G 2300/0819* (2013.01); *G09G 2320/045* (2013.01)

(58) Field of Classification Search
CPC ..... G09G 3/3241; G09G 2300/0819; G09G 2320/045
See application file for complete search history.

(56) References Cited

U.S. PATENT DOCUMENTS 8,242,983 B2 * 8/2012 Yoo ..... G09G 3/3233 315/169.3
8,405,579 B2 * 3/2013 Choi ..... G09G 3/3283 345/30

(Continued)

FOREIGN PATENT DOCUMENTS

CN 102044213 A 5/2011
CN 102110407 A 6/2011
CN 106991963 A 7/2017

*Primary Examiner* — Patrick N Edouard
*Assistant Examiner* — Eboni N Giles
(74) *Attorney, Agent, or Firm* — Hemisphere Law, PLLC; Zhigang Ma

(57) ABSTRACT

The present disclosure provides a pixel including a first transistor, a second transistor, a third transistor, a fourth transistor, a capacitor, and an OLED; the second transistor and the third transistor are turned on in the first period to charge the capacitor with a data current, until the current flowing through the second transistor is 0 and the current flowing through the first transistor is the data current, the capacitor stores a voltage corresponding to the data current; the fourth transistor is turned on in the second period to cause the OLED to emit light, and the voltage stored by the capacitor corresponding to the data current causes the current flowing through the OLED to coincide with the current flowing through the first transistor in the first period. The present disclosure can make the current flowing through the OLED not change with the threshold voltage of the driving transistor.

10 Claims, 4 Drawing Sheets

(56) References Cited

U.S. PATENT DOCUMENTS

| | | | | |
|---|---|---|---|---|
| 9,236,001 | B2 * | 1/2016 | Ishii | G09G 3/003 |
| 9,704,433 | B2 * | 7/2017 | Kim | G09G 3/3233 |
| 2006/0248420 | A1 * | 11/2006 | Jeong | G09G 3/3233 714/727 |
| 2016/0314740 | A1 * | 10/2016 | Wu | G09G 3/3258 |
| 2019/0164501 | A1 * | 5/2019 | Chai | H01L 27/3276 |
| 2019/0180687 | A1 * | 6/2019 | Gai | G09G 3/3258 |

* cited by examiner

PIXEL AND DISPLAY DEVICE HAVING THE PIXEL

RELATED APPLICATIONS

The present application is a Continuation Application of International Application Number PCT/CN2018/074008, filed Jan. 24, 2018, and claims the priority of China Application No. 201711479647.7, filed Dec. 29, 2017.

FIELD OF THE DISCLOSURE

The present disclosure relates to a display technology field, and more particularly to a pixel and a display device having the pixel.

BACKGROUND OF THE DISCLOSURE

In recent years, Organic Light-Emitting Diode (OLED) displays have become very popular emerging flat panel displays both at home and abroad. This is because OLED displays are self-luminous, wide viewing angle, short reaction time, high luminous efficiency, wide color gamut, low operating voltage, thin thickness, can produce large size and flexible display and simple process characteristics, and it also has the potential of low cost.

In OLED displays, thin film transistors (TFTs) are often used in conjunction with capacitor storage signals to control the luminance gray scale of an OLED. In order to achieve the purpose of constant current drive, each pixel needs at least two TFT and a storage capacitor to form, that is, 2T1C mode. FIG. 1 is a circuit diagram of a pixel of a conventional OLED display. Referring to FIG. 1, a pixel of an existing OLED display includes two thin film transistors (TFTs) and a capacitor, and specifically includes a switching TFT T1, a driving TFT T2, and a storage capacitor Cs. The driving current of the OLED is controlled by the driving TFT T2, the current size is: $I_{OLED}=k(V_{gs}-V_{th})^2$, where k is the intrinsic conduction factor of the driving TFT T2, which is determined by the characteristics of the driving TFT T2 itself, $V_{th}$ is the threshold voltage of the driving TFT T2, and $V_{gs}$ is the voltage between the gate and the source of the driving TFT T2. Due to long-term operation, the threshold voltage $V_{th}$ of the driving TFT T2 may drift, thereby causing the driving current of the OLED to change, so that the display of the OLED display may be poor, and the quality of the display may be affected.

SUMMARY OF THE DISCLOSURE

In order to solve the above problems in the prior art, an object of the present disclosure is to provide a pixel capable of changing a current flowing through an organic light emitting diode without a threshold voltage shift of a driving transistor and a display device having the pixel.

According to an aspect of the present disclosure, there is provided a pixel including a first transistor, a second transistor, a third transistor, a fourth transistor, a capacitor, and an organic light emitting diode; the second transistor and the third transistor are turned on in the first period to charge the capacitor with a data current, until the current flowing through the second transistor is 0 and the current flowing through the first transistor is the data current, the capacitor stores a voltage corresponding to the data current; the fourth transistor is turned on in the second period to cause the organic light emitting diode to emit light, and the voltage stored by the capacitor corresponding to the data current causes the current flowing through the organic light emitting diode to coincide with the current flowing through the first transistor in the first period.

Further, the fourth transistor is in the off state in the first period, and the second transistor and the third transistor are in the off state in the second period.

Further, the gate of the first transistor is connected to a first node, the first electrode of the first transistor is connected to the cathode of the organic light emitting diode, and the second electrode of the first transistor is connected to a second node to receive a second power voltage; the gate of the second transistor is for receiving a second scan signal, the second electrode of the second transistor is connected to the first node, and the first electrode of the second transistor is connected to the cathode of the organic light emitting diode; the gate of the third transistor is for receiving a second scan signal, the second electrode of the third transistor is connected to the cathode of the organic light emitting diode, and the first electrode of the third transistor is for receiving a data current; the gate of the fourth transistor is for receiving a first scan signal, the first electrode of the fourth transistor is for receiving a first power voltage, and the second electrode of the fourth transistor is connected to the anode of the organic light emitting diode; and the first terminal of the capacitor is connected to the first node, and the second electrode of the capacitor is connected to the second node to receive the second power voltage.

According to another aspect of the present disclosure, there is also provided a pixel including a first transistor having a gate connected to the first node and a second electrode connected to the second node to receive the second power voltage; a second transistor having a gate for receiving a second scan signal and a second electrode thereof connected to the first node; a third transistor having a gate for receiving a second scan signal and a first electrode for receiving a data current; a fourth transistor having a gate for receiving the first scan signal and a first electrode for receiving the first power voltage; a capacitor having a first terminal connected to the first node and a second electrode connected to the second node to receive a second power voltage; an organic light emitting diode having an anode connected to the second electrode of the fourth transistor, and the cathodes thereof are respectively connected with the first electrode of the first transistor, the first electrode of the second transistor, and the second electrode of the third transistor.

Further, the second transistor and the third transistor are in an on state in the first period, and the fourth transistor is in an on state in the second period.

Further, the fourth transistor is in an off state in the first period, and the second transistor and the third transistor are in an off state in the second period.

Further, each of the first through fourth transistors is an n-channel transistor.

Further, the second scan signal is kept at a high level in the first period, and the first scan signal is kept at a high level in the second period.

Further, the first scan signal is kept at a low level in the first period, and the second scan signal is kept at a low level in the second period.

According to another aspect of the present disclosure, there is also provided a display device including the above-described pixel.

The beneficial effects of the present disclosure are as follows: the pixel adopting the 4T1C pixel structure of the present disclosure can make the current flowing through the organic light emitting diode not change with the threshold voltage of the driving transistor, thereby eliminating the phenomenon of poor screen display caused by the threshold voltage shift of the driving transistor and further improving the display effect.

BRIEF DESCRIPTION OF THE DRAWINGS

The above and other aspects, features and advantages of the embodiments of the present disclosure will become more apparent from the following description taken in conjunction with the accompanying drawings.

DETAILED DESCRIPTION OF PREFERRED EMBODIMENTS

Figure 1:
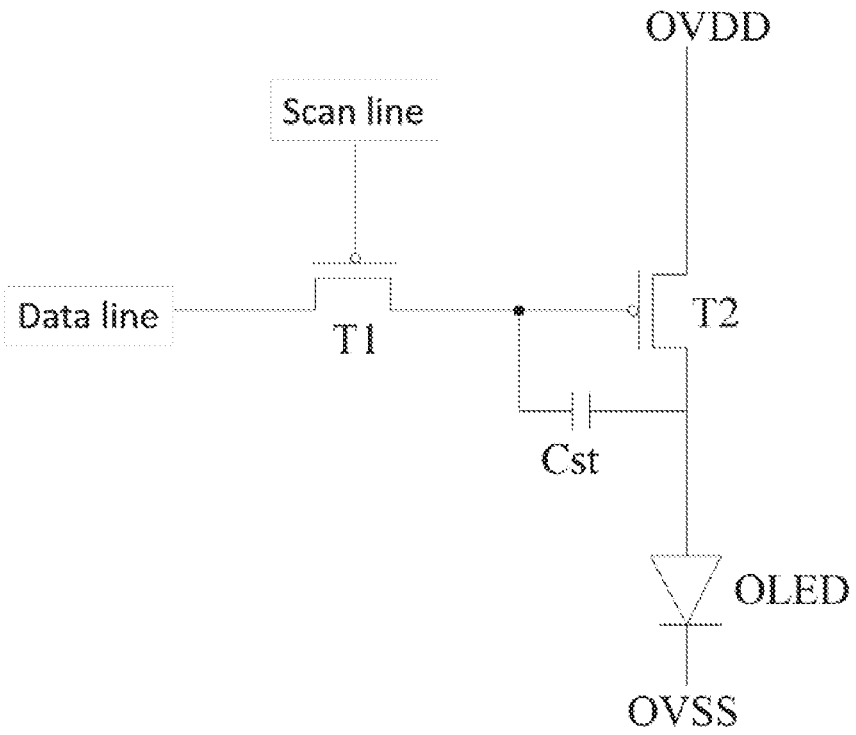
FIG. 1 is a circuit diagram of a pixel of an existing OLED display.

Hereinafter, embodiments of the present disclosure will be described in detail with reference to the accompanying drawings. However, the disclosure may be embodied in many different forms and should not be construed as limited to the specific embodiments set forth herein. Rather, these embodiments are provided to explain the principles of the disclosure and its practical application to thereby enable those of ordinary skill in the art to understand various embodiments of the disclosure and various modifications as are suited to the particular use contemplated.

In the drawings, the thickness of layers and regions is exaggerated for clarity of the device. The same reference numbers indicate the same components throughout the specification and the drawings.

Figure 2:
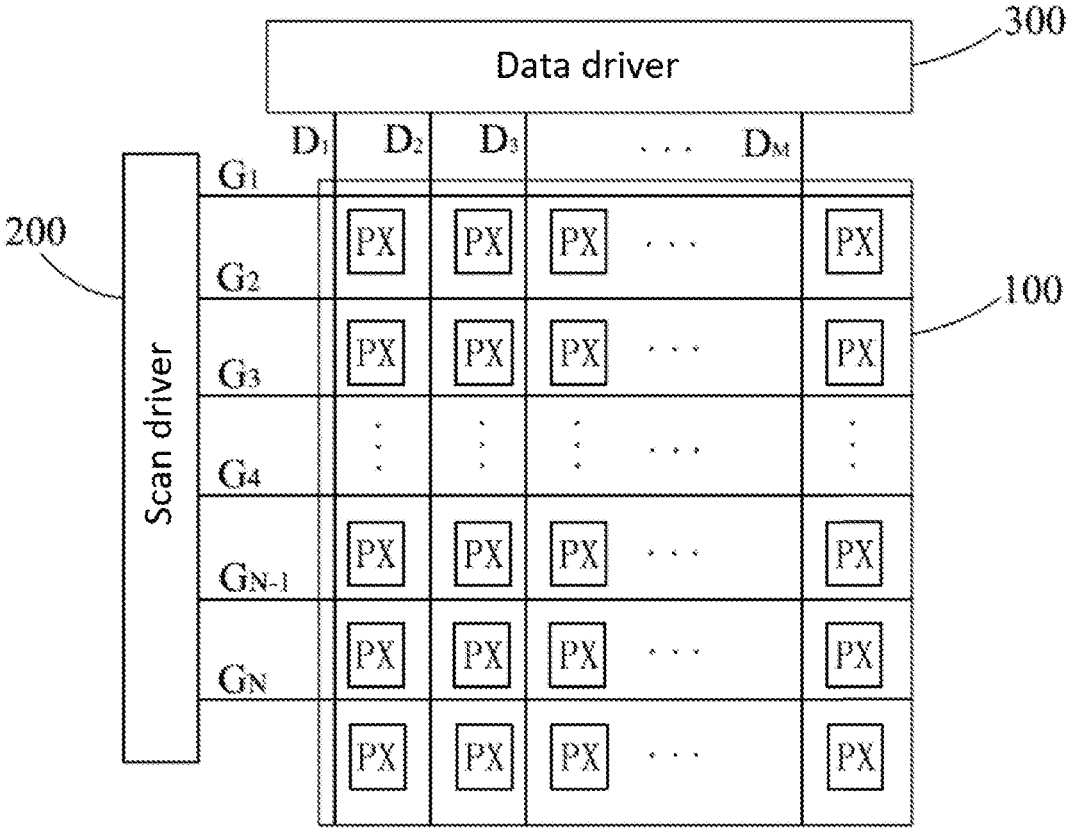
FIG. 2 is an architectural view of a display device according to the embodiment of the present disclosure.

FIG. 2 is an architectural diagram of a display device according to the embodiment of the present disclosure.

Referring to FIG. 2, the display device according to the embodiment of the present disclosure includes a display panel 100, a scan driver 200, and a data driver 300. It should be noted, the display device according to an embodiment of the present disclosure may further include other suitable devices such as a timing controller that controls the scan driver 200 and the data driver 300 and a power voltage generator that provides a first power voltage and a second power voltage. In the present embodiment, the first power voltage is usually a high voltage, and the second power voltage is usually a low voltage.

Specifically, the display panel 100 includes a plurality of pixels PX arranged in an array, N scan lines $G_1$ to $G_N$, and M data lines $D_1$ to $D_M$. The scan driver 200 is connected to the scan lines $G_1$ to $G_N$ and drives the scan lines $G_1$ to $G_N$. The data driver 300 is connected to the data lines $D_1$ to $D_M$ and drives the data lines $D_1$ to $D_M$.

The scan driver 200 can provide one or more scan signals to each pixel PX, which will be described later. The data driver 300 can provide a data voltage (or data current) to each pixel PX, which will also be described later.

The pixel structure of the pixel PX according to the embodiment of the present disclosure will be described in detail below.

Figure 3:
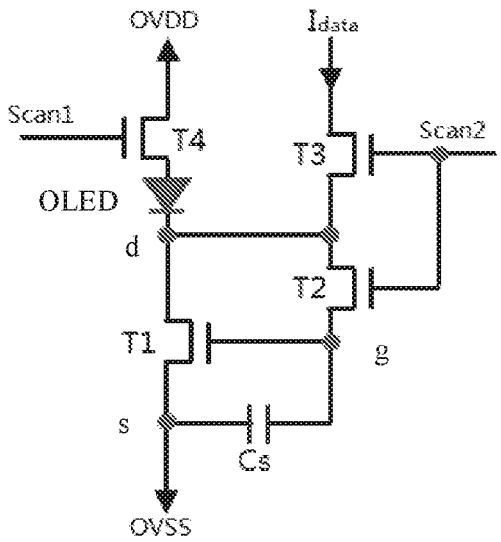
FIG. 3 is a circuit diagram of a pixel according to the embodiment of the present disclosure.

FIG. 3 is a circuit diagram of a pixel according to the embodiment of the present disclosure.

Referring to FIG. 3, each of the pixels PX of the display device according to the embodiment of the present disclosure has a 4T1C pixel structure, the 4T1C pixel structure includes an organic light emitting diode OLED, a first transistor T1, a second transistor T2, a third transistor T3, a fourth transistor T4, and a capacitor Cs.

The gate of the first transistor T1 is electrically connected to the first node g, the first electrode thereof is electrically connected to the second node s to receive the second power voltage OVSS, and the second electrode thereof is connected to the third node d.

The gate of the second transistor T2 is for receiving the second scan signal Scan2 (which is provided by the scan driver 200), the first electrode thereof is connected to the third node d and the second electrode thereof is connected to the first node g.

The gate of the third transistor T3 is for receiving the second scan signal Scan2, the first electrode thereof is for receiving the data current $I_{data}$ (which is provided by the data driver 300), and the second electrode thereof is electrically connected to the third node d.

The gate of the fourth transistor T4 is for receiving the first scan signal Scan1 (which is provided by scan driver 200), the first electrode thereof is for receiving the first power voltage OVDD, and the second electrode thereof is connected to the anode of the organic light emitting diode OLED.

The first end of the capacitor Cs is connected to the first node g, and the second end of the capacitor Cs is electrically connected to the second node s to receive the second power voltage OVSS.

In the present embodiment, the first power voltage OVDD is at a high level and the second power voltage OVSS is at a low level.

In the present embodiment, the first transistor T1 serves as a driving transistor.

Here, the first electrode of each of the first to fourth transistors T1 to T4 may be a source or a drain, and the second electrode of each of the first to fourth transistors T1 to T4 may be different from the first electrode.

For example, when the first electrode is a drain, the second electrode is a source, and when the first electrode is a source, the second electrode is a drain.

Each of the first to fourth transistors T1 to T4 may have the same channel shape.

For example, each of the first to fourth transistors T1 to T4 may have an n-channel shape.

Therefore, each of the first to fourth transistors T1 to T4 may be implemented with a polysilicon thin film transistor, an amorphous silicon thin film transistor, or an oxide thin film transistor.

Figure 4:
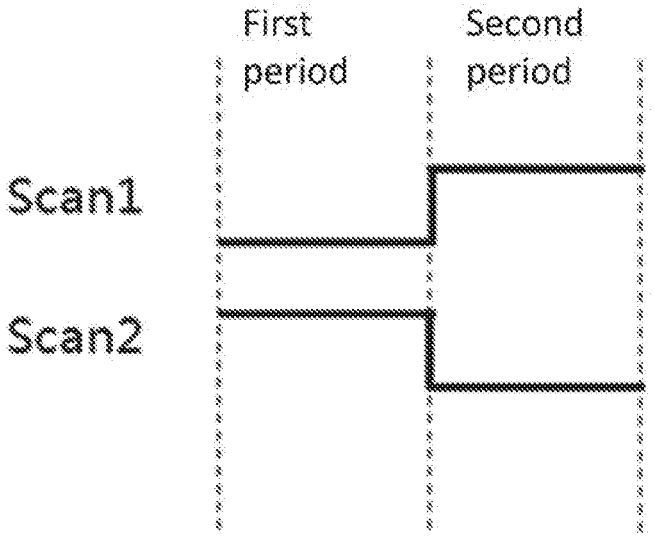
FIG. 4 is a timing diagram of a first scan signal and a second scan signal according to the embodiment of the present disclosure.
Figure 5A:
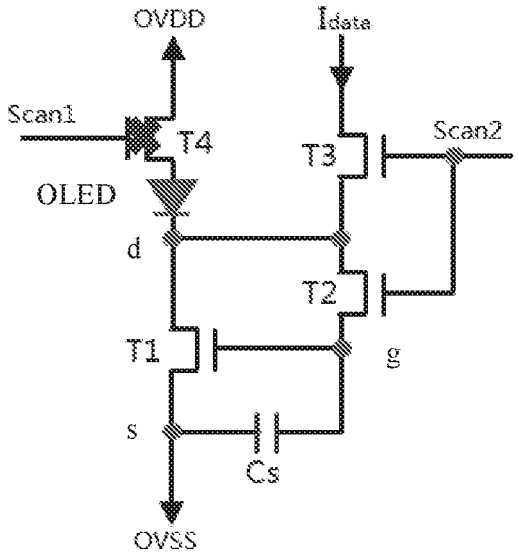
FIG. 5A and FIG. 5B are operational process diagrams of the pixel according to the embodiment of the present disclosure.
Figure 5B:
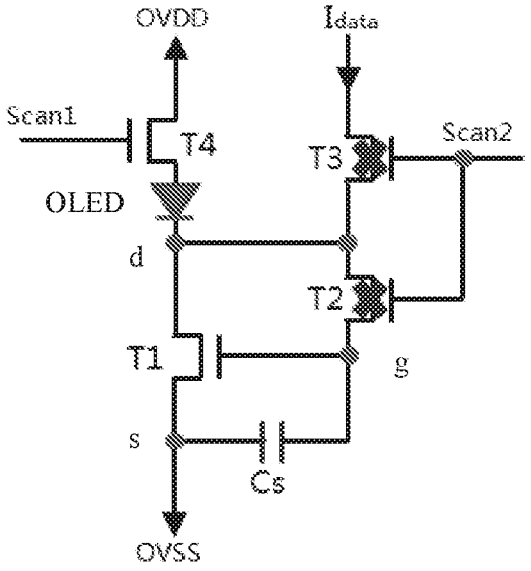

The operation principle of the pixel according to the embodiment of the present disclosure will be described in detail below. In the present embodiment, the pixel charge storage (i.e., the first period) and the light emitting display operation (i.e., the second period) according to the embodiment of the present disclosure of 4T1C pixel structure are employed. FIG. 4 is a timing diagram of a first scan signal and a second scan signal according to the embodiment of the present disclosure. FIG. 5A and FIG. 5B are operational process diagrams of the pixel according to the embodiment of the present disclosure. In FIGS. 5A and 5B, the cross symbol (x) on the transistor indicates that the transistor is in the off state.

In the first period, referring to FIGS. 4 and 5A, the second scan signal Scan2 is at a high level, and the second transistor T2 and the third transistor T3 are turned on. The data current $I_{data}$ charges the capacitor Cs through the second transistor T2 and the third transistor T3, in this way, the current flowing through the second transistor T2 gradually decreases, and the current flowing through the first transistor T1 gradually increases, until the current flowing through the second transistor T2 is 0 and the current flowing through the first transistor T1 is the data current $I_{data}$, the charging of the capacitor Cs is completed and the voltage corresponding to the data current $I_{data}$ is stored in the capacitor Cs (that is, the voltage difference between the voltage at the first node g and the voltage at the second node s is a voltage corresponding to the data current $I_{data}$). In addition, since the first scan signal Scan1 is at a low level, the fourth transistor T4 is turned off, and therefore, the organic light emitting diode OLED does not emit light.

In the second period, referring to FIGS. 4 and 5B, the second scan signal Scan2 is at a low level, and the second transistor T2 and the third transistor T3 are turned off. The voltage stored in the capacitor Cs coincides with the voltage stored in the capacitor Cs in the first period, that is, the voltage corresponding to the data current $I_{data}$. The first scan signal Scan1 is at a high level, the fourth transistor T4 is turned on, the organic light emitting diode OLED emits light, since the voltage stored on the capacitor Cs coincides with the voltage stored on the capacitor Cs in the first period and is the voltage corresponding to the data current $I_{data}$, the voltage difference between the voltage at the first node g and the voltage at the second node s is still the voltage corresponding to the data current $I_{data}$ so that the current flowing through the organic light emitting diode OLED matches the current flowing through the first transistor T1 in the first period, that is the data current $I_{data}$.

In this way, when the organic light emitting diode OLED emits light, the organic light emitting diode OLED flows through the data current $I_{data}$ irrespective of the threshold voltage of the first transistor T1 (i.e., the driving transistor).

In summary, according to the embodiment of the present disclosure, the current flowing through the organic light emitting diode is independent of the threshold voltage of the driving transistor, so that the display failure caused by the drift of the threshold voltage of the driving transistor is eliminated and the display effect of the picture is improved.

Although the disclosure has been shown and described with reference to specific embodiments, it will be understood by those skilled in the art that various changes in form and details may be made therein without departing from the spirit and scope of the disclosure as defined by the appended claims and their equivalents.

What is claimed is:

1. A pixel, comprising: a first transistor, a second transistor, a third transistor, a fourth transistor, a capacitor, and an organic light emitting diode;

wherein the second transistor and the third transistor are turned on in a first period to charge the capacitor with a data current, until a current flowing through the second transistor is 0 and a current flowing through the first transistor is the data current, the capacitor stores a voltage corresponding to the data current;

the fourth transistor is turned on in a second period to cause the organic light emitting diode to emit light, and the voltage stored by the capacitor corresponding to the data current causes a current flowing through the organic light emitting diode to coincide with the current flowing through the first transistor in the first period, wherein, a gate of the first transistor is connected to a first node, a first electrode of the first transistor is connected to a cathode of the organic light emitting diode, and a second electrode of the first transistor is connected to a second node to receive a second power voltage; a gate of the second transistor is configured to receive a second scan signal, a second electrode of the second transistor is connected to the first node, and a first electrode of the second transistor is connected to the cathode of the organic light emitting diode; a gate of the third transistor is configured to receive a second scan signal, a second electrode of the third transistor is connected to the cathode of the organic light emitting diode, and a first electrode of the third transistor is configured to receive the data current; a gate of the fourth transistor is configured to receive a first scan signal, a first electrode of the fourth transistor is configured to receive a first power voltage, and a second electrode of the fourth transistor is connected to an anode of the organic light emitting diode; and a first terminal of the capacitor is connected to the first node, and a second electrode of the capacitor is connected to the second node to receive the second power voltage.

2. The pixel according to claim 1, wherein the fourth transistor is in an off state in the first period, and the second transistor and the third transistor are in an off state in the second period.

3. The pixel according to claim 1, wherein each of the first through fourth transistors is an n-channel transistor.

4. The pixel according to claim 2, wherein each of the first through fourth transistors is an n-channel transistor.

5. The pixel according to claim 3, wherein the second scan signal is kept at a high level in the first period, and the first scan signal is kept at a high level in the second period.

6. The pixel according to claim 4, wherein the second scan signal is kept at a high level in the first period, and the first scan signal is kept at a high level in the second period.

7. The pixel according to claim 3, wherein the first scan signal is kept at a low level in the first period, and the second scan signal is kept at a low level in the second period.

8. The pixel according to claim 4, wherein the first scan signal is kept at a low level in the first period, and the second scan signal is kept at a low level in the second period.

9. A display device comprising the pixel according to claim 1.

10. The display device according to claim 9, wherein each of the first through fourth transistors is an n-channel transistor; the second scan signal is kept at a high level in the first period, and the first scan signal is kept at a high level in the second period; the first scan signal is kept at a low level in the first period, and the second scan signal is kept at a low level in the second period.

* * * * *